US007196478B2

(12) United States Patent
Dijkstra

(10) Patent No.: US 7,196,478 B2
(45) Date of Patent: Mar. 27, 2007

(54) CIRCUIT ARRANGEMENT

(75) Inventor: Jacob Dijkstra, Drachten (NL)

(73) Assignee: Koninklike Philips Electronics, N.V., Eindhoven (NL)

( * ) Notice: Subject to any disclaimer, the term of this patent is extended or adjusted under 35 U.S.C. 154(b) by 52 days.

(21) Appl. No.: 10/494,749

(22) PCT Filed: Oct. 24, 2002

(86) PCT No.: PCT/IB02/04446

§ 371 (c)(1),
(2), (4) Date: May 7, 2004

(87) PCT Pub. No.: WO03/043387

PCT Pub. Date: May 22, 2003

(65) Prior Publication Data

US 2005/0007032 A1 Jan. 13, 2005

(30) Foreign Application Priority Data

Nov. 12, 2001 (EP) ..... 01204297

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl. ..... 315/209 R; 315/307; 250/504 R

(58) Field of Classification Search ..... 315/209 R, 315/307, 362, DIG. 2, DIG. 7; 250/504 R, 250/504, 493, 495; 313/12, 28; 607/94, 607/91

See application file for complete search history.

(56) References Cited

U.S. PATENT DOCUMENTS 3,760,224 A * 9/1973 Shimizu et al. ..... 315/94
4,107,579 A * 8/1978 Bodine et al. ..... 315/205

(Continued)

FOREIGN PATENT DOCUMENTS

EP 1045623 A2 * 10/2000

*Primary Examiner*—Don Wong
*Assistant Examiner*—Marie Antoinette Cabucos
(74) *Attorney, Agent, or Firm*—Adam L. Stroud; Russell Gross

(57) ABSTRACT

A driver for driving a gas discharge lamp includes an inductive ballast implemented as auto-transformer having a central tap, connected between one output terminal and a first input terminal, and a triac connected between a second output terminal and a second input terminal. The central tap of the ballast is connected, via a capacitor, to the second output terminal. A control unit has a sense input for sensing the phase of an input voltage at the first input terminal, and is adapted to trigger the triac at a predetermined phase ($\Phi_p$) after a zero-crossing of the input voltage, the predetermined phase ($\Phi_p$) being in the range of $\Delta\Phi+10°$ to $\Delta\Phi+15°$, $\Delta\Phi$ being the nominal phase lag of the lamp current with respect to the input voltage.

31 Claims, 7 Drawing Sheets

U.S. PATENT DOCUMENTS 4,177,384 A * 12/1979 Wolff ..... 250/494.1
4,560,883 A * 12/1985 Kerschgens ..... 250/504 R
4,700,111 A * 10/1987 Folwell et al. ..... 315/200 R
5,424,617 A * 6/1995 Garbowicz et al. ..... 315/289
5,537,010 A * 7/1996 Johnson et al. ..... 315/307
5,631,523 A * 5/1997 Rothenbuhler et al. ..... 315/307
5,652,481 A * 7/1997 Johnson et al. ..... 315/308
5,736,817 A * 4/1998 Rothenbuhler et al. ..... 315/106
5,757,145 A * 5/1998 Johnson et al. ..... 315/308
5,801,494 A * 9/1998 Herres et al. ..... 315/289

* cited by examiner

CIRCUIT ARRANGEMENT

The present invention relates in general to a device for driving inductive load circuits, especially circuits comprising gas discharge lamps. More particularly, the present invention relates to problems occurring during the starting phase of such gas discharge lamp.

Drivers for driving gas discharge lamps are commonly known. Generally, these drivers are intended to receive an AC mains voltage, and to convert this input mains voltage to a power suitable for driving the lamps. A special problem in relation to gas discharge lamps relates to a starting phase. For starting a lamp after an OFF stage, drivers are provided with a starter circuit.

Starter circuits are generally known. Although they generally work satisfactorily in the sense that they succeed in starting a lamp, conventional starter circuits may cause relatively large asymmetric peak currents on the mains line. This is undesirable. It is already known to suppress such high peak currents by means of NTC resistors connected in series with the load. However, a disadvantage is that the current-limiting capabilities of these components last only a relatively short time, typically of the order of ten milliseconds, while the starting phase during which high peak currents may occur typically lasts some hundreds of milliseconds or even more than one second.

An important aim of the present invention is to prevent current peaks during the starting phase of a gas discharge lamp.

A further aim of the present invention is to provide a driver with dimming capabilities, able to dim a gas discharge lamp without generating current peaks.

The present invention is partly based on the inventor's recognition that the high current peaks are due, on the one hand, to lamp behavior immediately after ignition and, on the other hand, to a wrong ignition moment of the lamp.

The present invention is further based on an understanding of the physical mechanism causing said current peaks. Based on this understanding, the present invention proposes to generate, during a starting phase, ignition pulses at a specific moment in relation to the phase of the lamp current.

These and other aspects, features and advantages of the present invention will be further explained in the following description of a preferred embodiment with reference to the drawings, in which identical reference numerals indicate the same or similar parts, and in which:

FIG. 1 schematically illustrates a block diagram of a conventional driver;

FIG. 2 is a graph illustrating voltage across and current through a gas discharge lamp;

FIG. 3A schematically illustrates a first embodiment in accordance with the present invention of a driver for a gas discharge lamp;

FIG. 3B schematically illustrates a second embodiment in accordance with the present invention of a driver for a gas discharge lamp;

Figure 1:
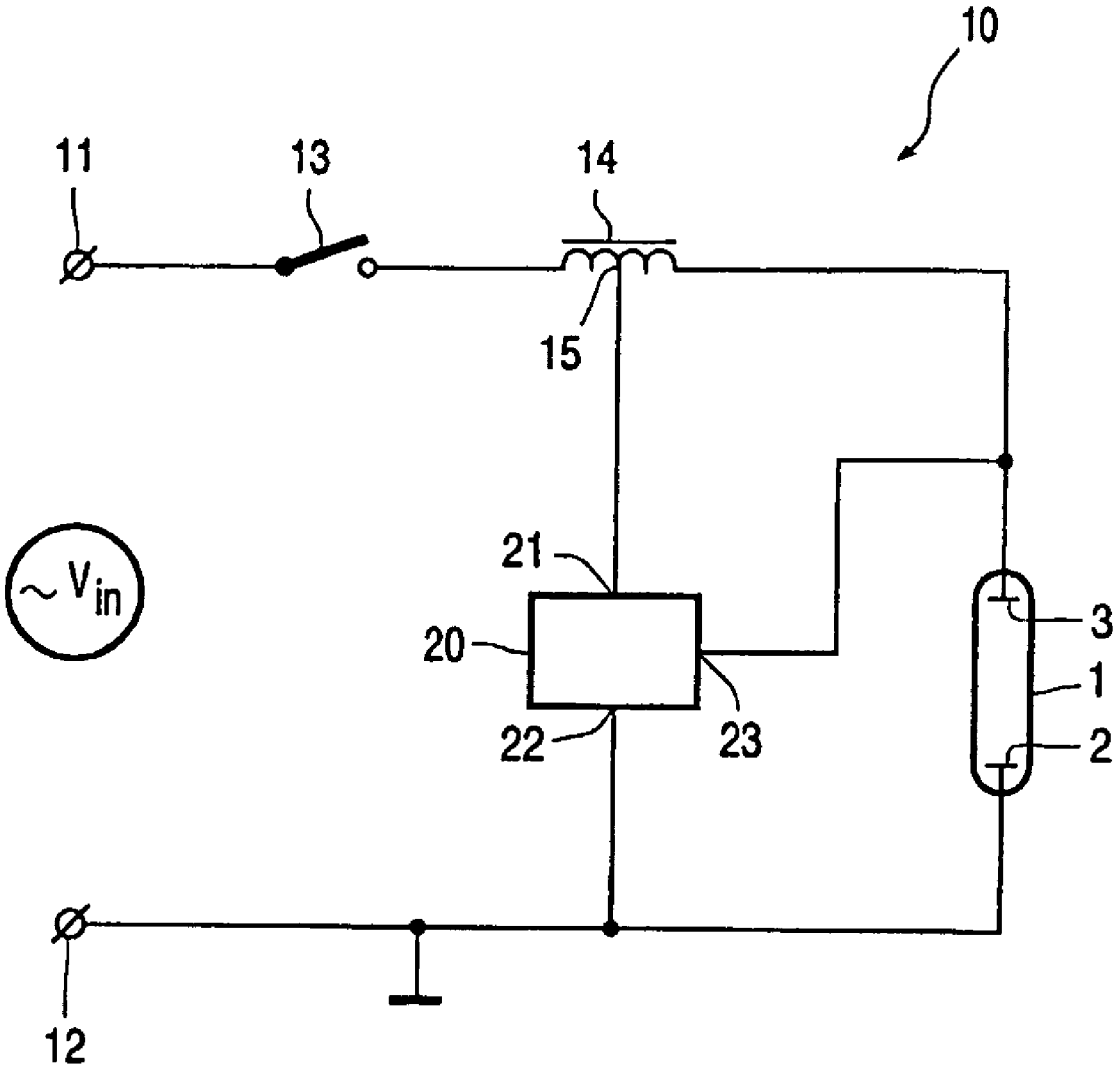

FIG. 1 schematically illustrates a block diagram of a conventional driver 10 for driving a gas discharge lamp 1 having lamp electrodes 2 and 3. The driver circuit 10 has input terminals 11 and 12 for connection to AC mains $V_{in}$, typically of the order of 230 V. The conventional driver 10 comprises, in series with the lamp 1, a switch 13 and a ballast device 14. The ballast device 14 serves to transform the received mains voltage to a higher voltage, and is typically implemented as an autotransformer with a central tap 15. The series combination of lamp and ballast constitutes an inductive load to the mains power supply.

The conventional driver 10 further comprises a starter circuit 20, having one terminal 21 connected to an intermediate terminal 15 of the ballast device 14, a second terminal 22 connected to one lamp electrode 2, and a third terminal 23 connected to the other lamp electrode 3. As will be explained in more detail, the starter circuit 20 of the conventional driver 10 is designed to generate ignition pulses across the lamp electrodes 2, 3, both during the positive half and the negative half of the AC voltage sine wave. Typically, the number of ignition pulses during each half period is more than one. After an ignition phase, when the gas discharge lamp has ignited, the starter circuit stops firing its ignition pulses.

In the following, the electric behavior of a gas discharge lamp will be explained with reference to FIG. 2, which schematically illustrates the waveform of the current $I_L$ through an inductive load L supplied by a sine-shaped alternating voltage $V_{in}$. It is noted that the load current $I_L$ is the same as the lamp current, therefore this current $I_L$ will hereinafter also be indicated as lamp current. Furthermore, the lamp voltage is substantially in phase with the lamp current.

As is commonly known, for an inductive load, the current lags behind the voltage, i.e. there is a phase difference $\Delta\phi$ between the phase of the input mains voltage $V_{in}$ and the phase of the load current $I_L$. In an ideal situation, if the load behaves as a pure inductive load, this phase difference $\Delta\phi$, in the following also indicated as phase lag, is exactly 90°. In the practical case of a gas discharge lamp 1 with a ballast 14, this phase lag $\Delta\phi$ is less than 90°, the exact value of the phase lag $\Delta\phi$ depending on the combination of actual ballast 14 and actual lamp 1. For instance, for a certain practical situation, when a lamp is just being started and is still relatively cold, this phase lag $\Delta\phi$ may be of the order of about 70°, which value is used in FIG. 2. When the temperature of the lamp rises, the phase lag $\Delta\phi$ will decrease, and in the steady state, typically reached in a time period of the order of about 40 seconds, the phase lag $\Delta\phi$ will be about 45° to 50° in this practical situation. In the following, the phase lag $\Delta\phi$ will be considered as a property of the combination of lamp 1 and ballast 14.

However, problems arise when the lamp is started. When a gas discharge lamp is started, its electrodes do not yet have the operational temperature. It takes some time before the lamp electrodes have reached their steady state operational temperature, which time may typically be of the order of half a second. During this warming up phase, the two lamp electrodes may warm up asymmetrically, which means that during this warming-up period there is a temperature difference between said two lamp electrodes. This temperature difference causes a DC offset in the burn voltage of the lamp. Also, the ballast itself causes a DC offset. All in all, a DC offset results in the voltage across the ballast, which in turn results in a DC offset in the current flowing through the ballast. The maximum possible current through the lamp ballast is related to the maximum possible magnetic flux in the core material of the ballast, which has an upper limit depending on the amount of magnetic material. If this material reaches magnetic saturation, the inductive value of the ballast will strongly decrease, resulting in a further increase of the lamp current. As a consequence, the lamp current may reach peak values of the order of 40 A and more.

According to an aspect of the present invention, a method of driving a gas discharge lamp, especially during a starting phase, is provided, wherein the occurrence of such high lamp currents can be counteracted by, on the one hand, limiting the amplitude of the lamp current and, on the other hand, ensuring that the lamp current is maintained at zero level during a certain time between subsequent half-periods. According to a further aspect of the invention, the same principle can be used to dim the lamp.

According to a special aspect of the present invention, this can be achieved by generating an ignition pulse and a starting pulse, substantially simultaneously, at a suitable timing with respect to the voltage phase. More particularly, said pulses are generated within a time window after the phase lag $\Delta\phi$, preferably within the time window between $\Delta\phi$ and 90°. Most preferably, said pulses are generated at a pulse phase $\phi_P$ which is 10 to 15° later than $\Delta\phi$.

According to a still further aspect of the present invention, a driver for driving a gas discharge device is provided, comprising a combination of a starter circuit and an ignition circuit, adapted to perform the above-mentioned method.

Figure 2:
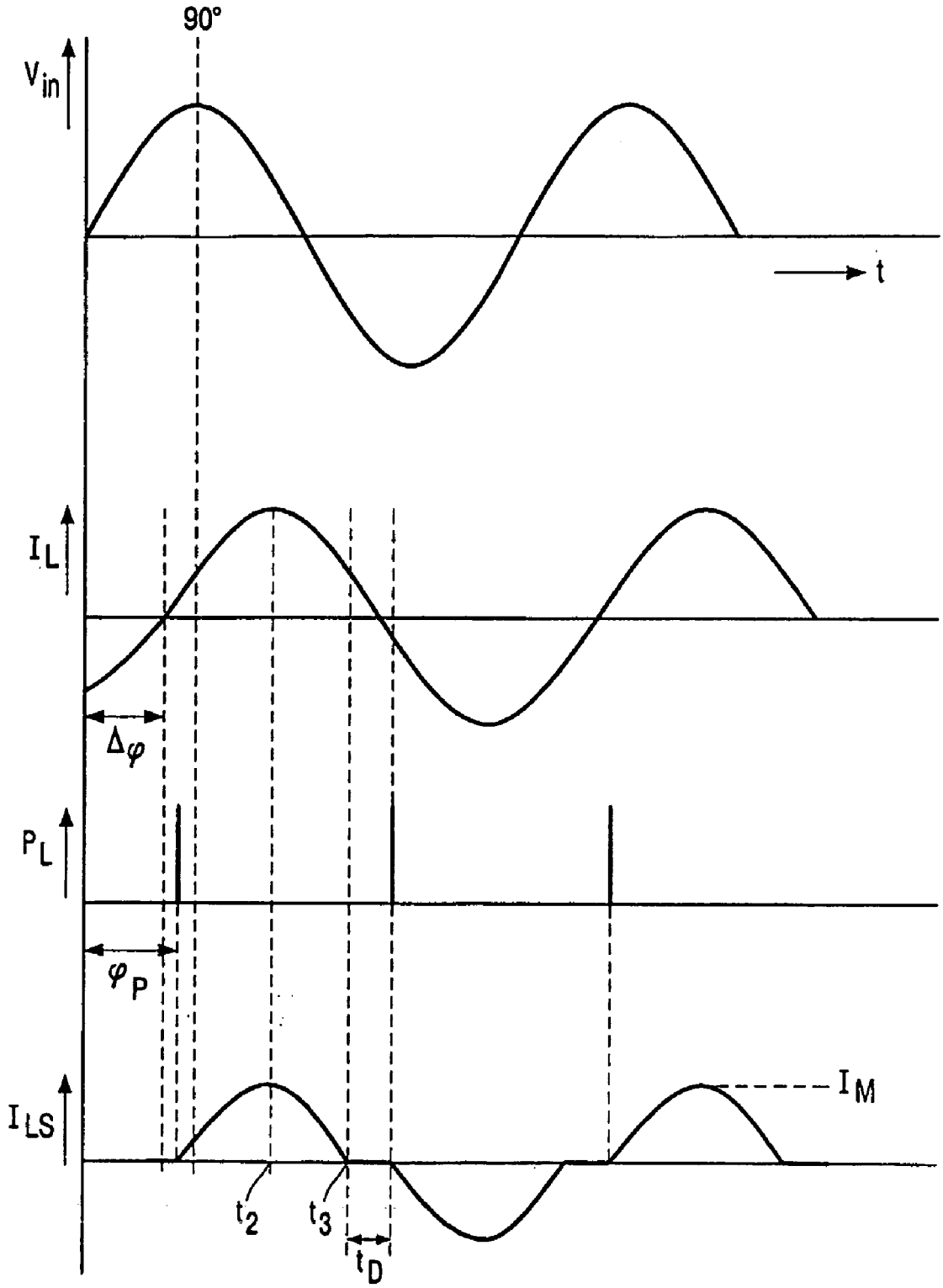

In FIG. 2, a zero-crossing of the mains voltage $V_{in}$ is taken as 0°. Lamp ignition pulses are shown at $P_L$; their timing is indicated as ignition pulse phase $\phi_P$, and will be expressed in degrees with respect to the mains voltage period.

In a conventional starter circuit, the phase $\phi_P$ of the ignition pulse $P_L$ typically ranges somewhere in the range between 40° and 90° as regards the positive half of the voltage period, and somewhere in the range of 220° to 270° as regards the negative voltage half. The exact value of the phase $\phi_P$ of the ignition pulse $P_L$ may either be at random or fixed at a predetermined value somewhere in said range. However, conventional starter circuits do not take into account the actual phase lag $\Delta\phi$ of the lamp current $I_L$, and the phase $\phi_P$ of the ignition pulse $P_L$ may be quite unsuitable; on starting the lamp, this may lead to a high asymmetric inrush current.

According to an important aspect of the present invention, however, during a starting phase, the timing of the ignition pulses is performed in relation to the actual current phase. More particularly, the ignition pulse phase $\phi_P$ is taken to be larger than the actual phase lag $\Delta\phi$ of the lamp current $I_L$. According to another important aspect of the present invention, the lamp current $I_L$ is made zero as soon as it is close to zero, and is maintained at zero level until the next ignition pulse.

The fourth graph of FIG. 2 illustrates the resulting waveform of the lamp current $I_{LS}$ during the starting phase. At the occurrence of an ignition pulse $P_L$, the lamp current $I_{LS}$ starts to rise. However, since the ignition pulse $P_L$ is later than the phase lag $\Delta\phi$ of the lamp, the lamp current $I_{LS}$ starts to rise later than the lamp current $I_L$ in the steady state situation as illustrated in the second graph, thus the lamp current $I_{LS}$ will constantly be lower as compared with the lamp current $I_L$ in the steady state situation.

It is also shown in FIG. 2 that the lamp current $I_{LS}$ will have its peak value $I_M$ at approximately the same moment $t_2$ as the lamp current $I_L$ in the steady state situation would have had, but the peak value $I_M$ is now lower.

It can also be seen in FIG. 2 that, during the starting phase, the lamp current $I_{LS}$ will reach zero at a time $t_3$ which is earlier than the time ($\Delta\phi$+90°) at which the lamp current $I_L$ in the steady state situation would have reached zero. According to the invention, the lamp current $I_{LS}$ is maintained at zero level until the time ($\Delta\phi$+90°) at which the next ignition pulse $P_L$ is generated.

Thus, the lamp current $I_{LS}$ will be OFF during a dark period $t_D$, which starts at $t_3$ before the original zero-crossing ($\Delta\phi$+90°) of the lamp current $I_L$ in the steady state situation and ends after said original zero-crossing.

The resulting limitation of the lamp current prevents, at least to a large extent, the occurrence of saturation of the ballast in the possible case of an offset in the lamp voltage.

The fact that the current remains zero during the dark period $t_D$ each half of the mains period results in a kind of reset of the circuit before a new ignition pulse is generated. This will result in an effective suppression of possibly occurring asymmetric phenomena.

It will be clear from the above that the exact value of the ignition pulse phase $\phi_P$ will have a great effect on the waveform of the lamp current $I_{LS}$ during the starting phase. If $\phi_P$ is too small, it may happen that the ballast, after ignition of the lamp, goes into saturation by itself which may lead to asymmetric current pulses on the mains line. If $\phi_P$ is too large, the energy input into the lamp may be insufficient for a reliable ignition of the lamp.

Typically, a starter circuit will be designed for a specific ballast/lamp combination, so that the phase lag $\Delta\phi$ between lamp current and mains voltage will be a design value which is known with a relatively high accuracy in advance. Then, it is possible to set the exact value of the ignition pulse phase $\phi_P$ at a predetermined fixed value which is larger than the design value of the phase lag $\Delta\phi$.

Preferably, the ignition pulse phase $\phi_P$ will be set at a predetermined value within the range from $\Delta\phi$ to 90°.

More preferably, the ignition pulse phase $\phi_P$ will be set at a predetermined value within the range from $\Delta\phi$+10° to $\Delta\phi$+15°, but not larger than 90°.

In a typical practical situation, where $\Delta\phi$ is approximately equal to 70°, a suitable value for the ignition pulse phase $\phi_P$ was found to be 85°.

Figure 3A:
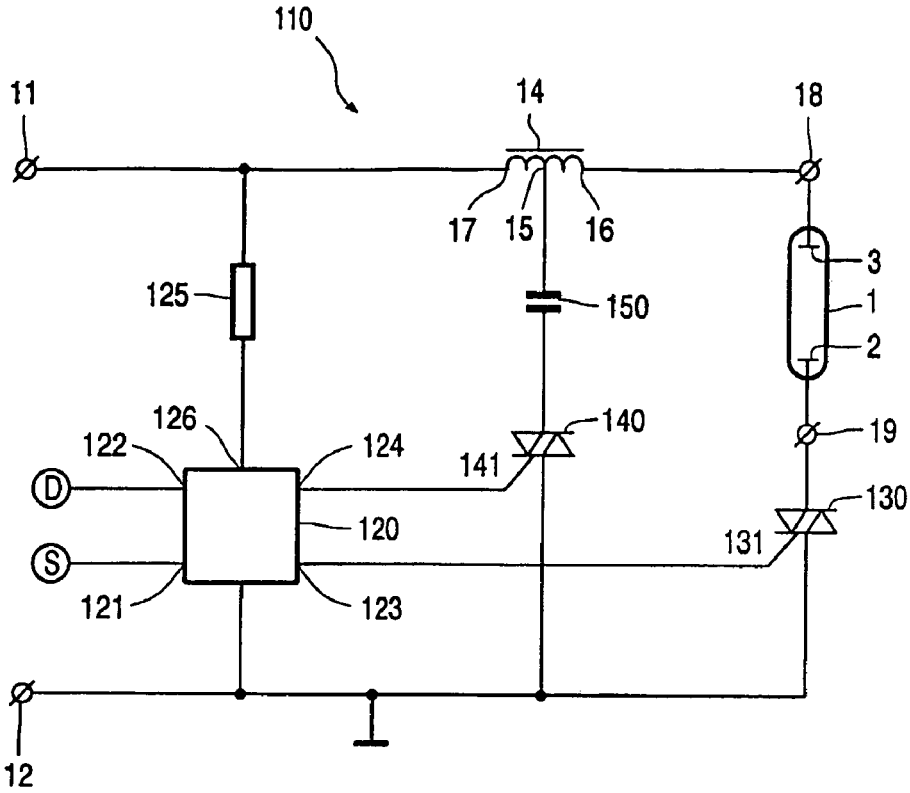

FIG. 3A schematically illustrates a first embodiment of a driver 110 for a gas discharge lamp 1. The driver 110 comprises a first triggerable switch 130 connected in series with the lamp 1 and the ballast 14, this triggerable switch having a trigger input 131. In a preferred implementation as shown, the first triggerable switch is a triac.

The driver 110 further comprises a second triggerable switch 140 having one terminal connected to input terminal 12 and having its other terminal connected, through a capacitor 150, to the central terminal 15 of the auto-transformer ballast 14. The second triggerable switch has a trigger input 141. This second triggerable switch preferably, and as shown, is also implemented as a triac.

The driver 110 further comprises a control unit 120 having a first output 123 connected to the trigger input 131 of the triac 130, and having a second output 124 connected to the trigger input 141 of the second triac 140. The control unit 120 may be implemented by analogue components, but preferably the control unit is implemented as a microcontroller, because such an implementation makes it easier to obtain an accurate timing. Other implementations are also possible. The control unit 120 is adapted to perform the method as described above, for instance by a suitable programming, as will be clear to a person skilled in the art.

As will be clear to a person skilled in the art, the micro-controller is adapted to generate adequate trigger pulses at its outputs 123 and 124, for triggering the first triac 130 and the second triac 140, respectively. Triggering the second triac 140 will result in generating ignition pulses by the auto-transformer ballast 14. Triggering the first triac 130 will switch the lamp current.

In the following, a soft start phase will be explained in more detail.

Generating Ignition Pulse

If the control unit 120 receives a command to start the lamp 1, for instance through a user-controlled switch S connected to a start signal input 121, the control unit 120 starts generating trigger pulses at its outputs 123 and 124 at a specific predetermined ignition pulse phase $\phi_P$ with respect to the mains phase. To this end, the micro-controller 120 is associated with a zero-crossing detection circuit 125, which may simply be implemented as a resistor with a high resistance value (typically of the order of 1 MΩ), connected between input terminal 11 and a sense input 126 of the micro-controller 120. Preferably, the trigger pulses at outputs 123 and 124 are generated simultaneously, although a little time difference may be acceptable.

After triggering of the triacs 130 and 140, the current in capacitor 150 will increase in a resonant manner, causing capacitor 150 to be charged till twice the value of the actual mains voltage. Since the ballast 14 is implemented as an auto-transformer, the actual mains voltage plus the resonantly increasing voltage across capacitor 150 will be transformed up to the output 16 of the ballast 14, so that the ballast 14 effectively generates a very high ignition pulse at its output 16, the magnitude of this ignition pulse typically being in the range of 2.5 kV or more. The actual magnitude of the ignition pulse depends, inter alia, on the actual value of the mains voltage at the time of ignition, the capacitive value of capacitor 150, and the primary to secondary windings ratio of the ballast 14. The width of the ignition pulse depends, inter alia, on the LC-time defined by the capacity of the capacitor 150 and the inductive value of the primary half of the ballast 14, i.e. that part between its input terminal 17 and its central terminal 15. In an embodiment which has proven suitable, this LC-time corresponds to a resonance frequency of about 4–5 kHz, but this resonance frequency may typically be chosen in the range of 3–6 kHz, although other frequencies are possible, too.

Increase of Lamp Current

Figure 4:
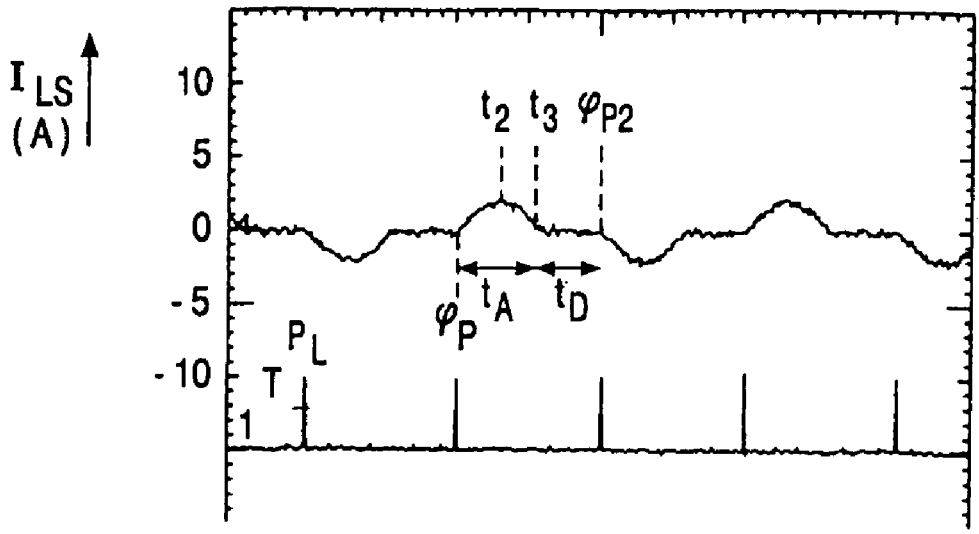
FIG. 4 is a graph showing the current through a lamp in relation to ignition pulses during a starting stage.

The ballast 14 and the capacitor 150 are designed in such a way that the magnitude of the ignition pulse generated at the output 16 of the ballast 14 is sufficiently higher than the ignition threshold of the lamp 1, so that the lamp will break down at the moment the ignition pulse is applied across its lamp electrodes 2, 3. As a result, a lamp current $I_{LS}$ can flow through the lamp 1. In this case, the lamp current $I_{LS}$ can only reach (time $t_2$ in FIG. 2) a limited maximum value $I_M$ owing to the fact that the ignition pulse phase $\phi_P$ is larger than the intrinsic current phase lag $\Delta\phi$. This is illustrated in FIG. 4, which shows the current $I_{LS}$ in relation to the trigger pulses $P_L$ as measured in an experimental setup. It can clearly be seen from FIG. 4 that the peak value $I_M$ of the current in this stage is about 2 A.

Decrease of Lamp Current

As the mains voltage $V_{in}$ is sine-shaped and decreases after having reached a maximum value, the lamp current $I_{LS}$ will also decrease after having reached its maximum value. Then, at some moment (time $t_3$ in FIG. 2), the lamp current $I_{LS}$ will pass the current maintenance level of the first triac 130, so that the first triac 130 goes from its conductive state to its non-conductive state, causing the lamp current to become zero. This moment will also be indicated as extinction moment $t_e$.

A subsequent trigger pulse for the triacs 130 and 140 will be generated at $\phi_P$+180°, again causing the lamp to break down and a lamp current to pass through the lamp 1, but now in the opposite direction. This second trigger moment within the same mains voltage period is indicated as $\phi_{P2}$ in FIG. 4. Thus, as is clearly visible in FIGS. 4 and 2, the lamp current $I_{LS}$ remains zero during the dark period $t_D$ between $t_e$ and $t_{P2}$. The time period between $\phi_P$ and $t_e$, during which a current flows through the lamp 1, will be indicated as active period $t_A$. In the experimental setup mentioned above, the dark period $t_D$ is substantially equal to the active period $t_A$, as is clearly visible in FIG. 4.

During a start stage, the above is repeated every 180°. Trigger pulses are generated at an ignition pulse phase $\phi_P$, which is specifically selected to have a value larger than the expected current lag phase $\Delta\phi$. Each trigger pulse causes an ignition pulse to be generated by the ballast 14, and each ignition pulse will cause the lamp 1 to break down again. As, during a starting stage, a new ignition pulse is generated after each dark period $t_D$, the lamp 1 will not get any opportunity to de-ionize untimely.

Increase of Peak Value

Figure 5:
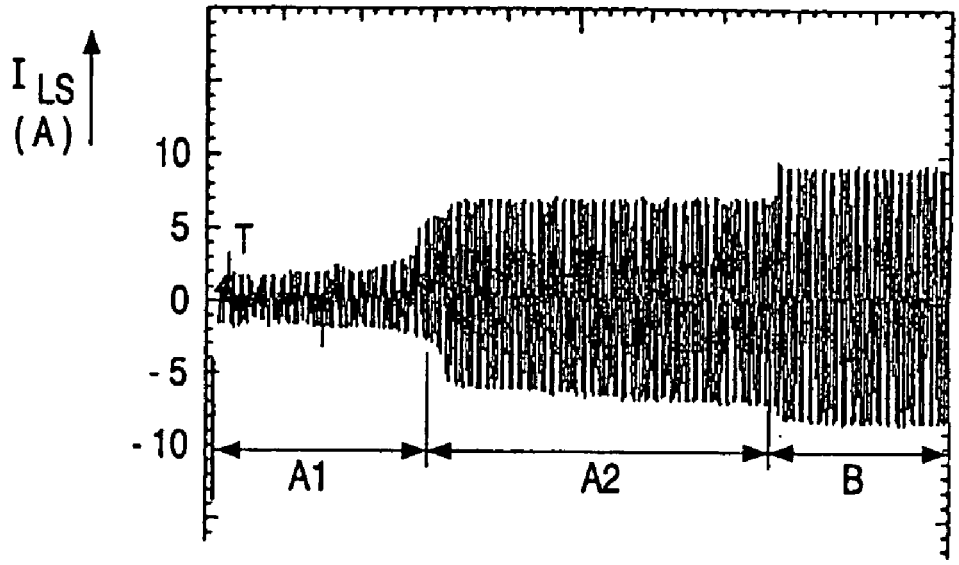
FIG. 5 is a graph similar to FIG. 4 on a larger time scale.
Figure 6:
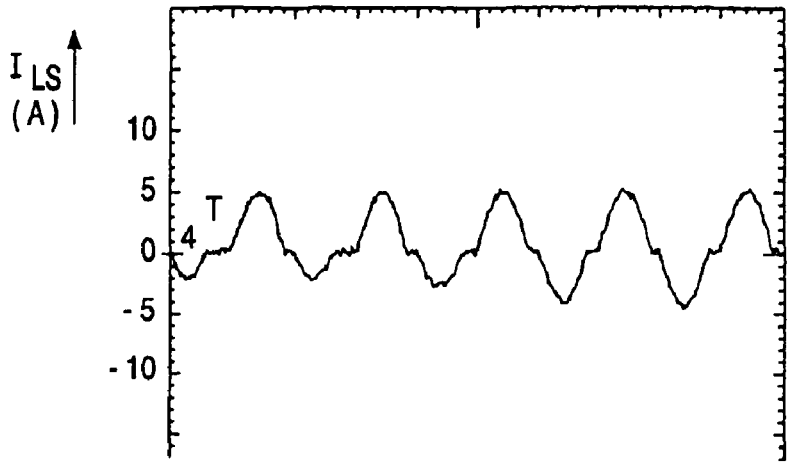
FIG. 6 is a graph similar to FIG. 4 at a later moment.

During the ignition stage, the peak value $I_M$ of the lamp current will increase in subsequent active periods $t_A$. FIG. 5 is a graph showing the lamp current $I_{LS}$ on a different time scale with respect to FIG. 4. The ignition stage is taken sufficiently large, for instance about 2.5 seconds. In FIG. 5, the total horizontal length of the time scale corresponds to 3.2 seconds. In this graph, the ignition stage is indicated by A. The ignition stage A can be divided into two sub-stages, indicated by A1 and A2 in FIG. 5. During the first sub-stage A1 of the ignition stage A, the maximum value $I_M$ of the lamp current will increase, although possibly in an asymmetric manner. This is illustrated in FIG. 6, which is a graph similar to FIG. 4 taken at a later moment within the first sub-stage A1. It can clearly be seen in FIG. 6, specifically in the left half thereof, that the positive current peaks have a larger magnitude than the negative current peaks. However, because of the dark period $t_D$ between subsequent current peaks, the problems of the state of the art are effectively suppressed.

After about one second, the peak magnitude $I_M$ of the current pulses will hardly increase anymore. This indicates the transition to the second sub-stage A2 in FIG. 5. The lamp is now operating well, and will no longer show any asymmetric phenomena.

Especially during the first sub-stage A1, the dark time $t_D$ will decrease because the extinction moment $t_e$, will shift to a later moment because of the increasing lamp current. This is already visible in FIG. 6, and also in FIG. 7, which is a graph similar to FIG. 6 but taken at the end of the ignition stage A. After the ignition stage A, the normal operation stage B of the lamp 1 is entered, in which the first triac 130 is triggered continuously. The second triac may also be triggered continuously, but this is of no relevance.

Normal Operation

Figure 7:
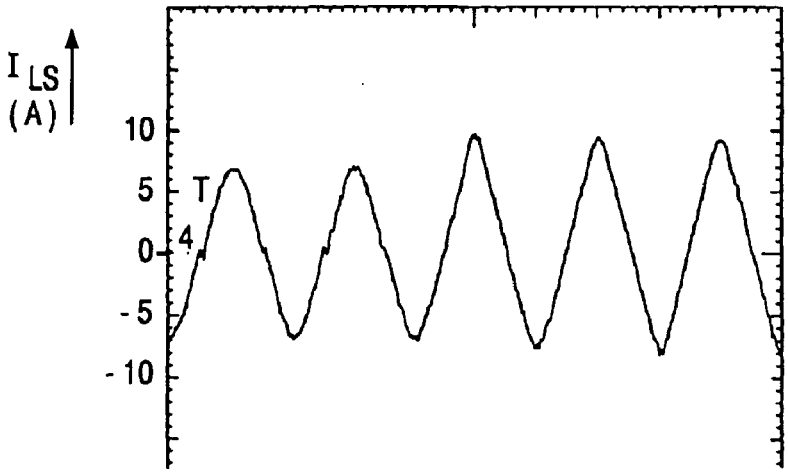
FIG. 7 is a graph similar to FIG. 4 at the transition from starting stage to normal operation.

This transition is clearly visible in FIG. 7. Now, at least the first triac 130 can be considered as being a constant short circuit, and the lamp circuit will effectively be only characterized by the lamp 1, the ballast 14 and the capacitor 150. It can be seen in FIG. 7 that the lamp current now has a substantially triangular shape, caused by the ballast being close to saturation; after some tens of seconds, typically within 30 to 50 seconds, the current will decrease and the voltage will increase and the waveform will be more sine-shaped.

Switching Off

If it is desired to switch off the lamp, the control unit 120 simply stops generating trigger pulses.

Figure 3B:
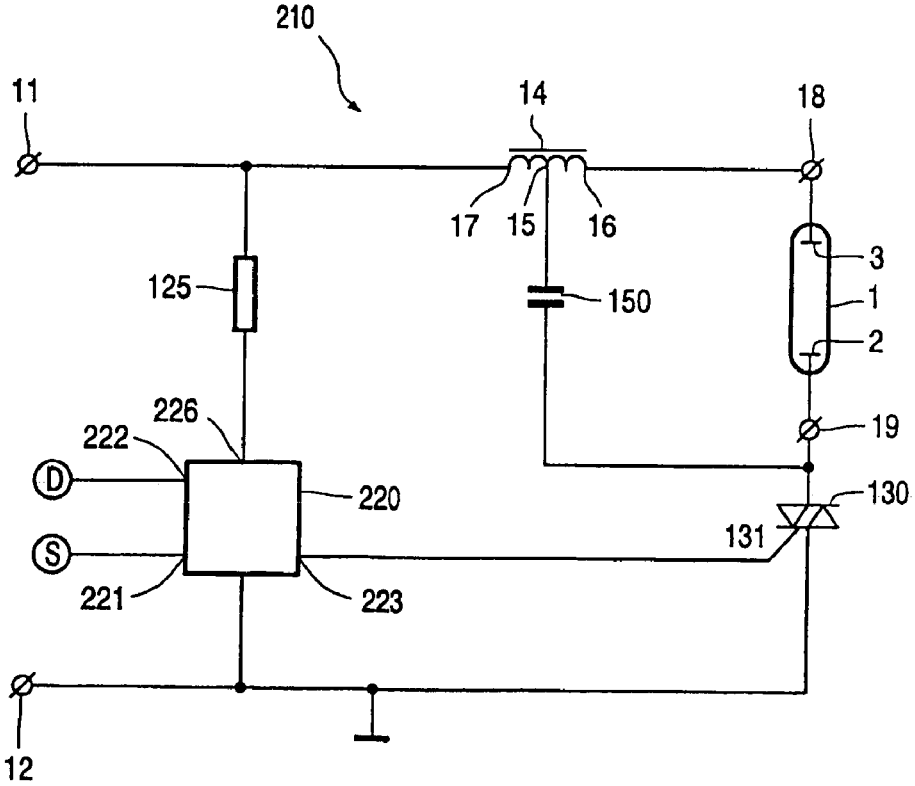

The driver 110 of FIG. 3A comprises two controllable switches. FIG. 3B illustrates an embodiment of a driver 210 according to the present invention which only comprises one controllable switch, in this case triac 130. The capacitor 150 has one terminal connected to the central tap 15 of the autotransformer ballast 14, as in the driver 110, and has its other terminal connected to the node between lamp 1 and triac 130. A micro-controller 220 only needs to generate trigger pulses at its output 223 connected to the trigger input 131 of the triac 130.

The driver 210 of FIG. 3B operates in the same way as the driver 110 of FIG. 3A, as will be clear to a person skilled in the art, taking into account that the micro-controller 110 generated its trigger pulses at its two outputs 123 and 124 substantially simultaneously. An advantage of the driver 210 is that it needs fewer components.

In the above, the invention has been explained in the context of solving starting problems. In normal operation, the triacs are triggered continuously. However, the present invention is also particularly useful for dimming a lamp, i.e. operating a lamp at a power less than nominal power.

Dimmed Operation

With reference to FIG. 3A, if the control unit 120 receives, during normal operation, a command to dim the lamp 1, for instance through a user-controlled switch D connected to a dim signal input 122, the control unit 120 again starts generating trigger pulses at its outputs 123 and 124 at a specific predetermined dim pulse phase $\phi_d$ with respect to the mains phase. The power output, i.e. the power put into the lamp, or the dim level, depends on the timing of the dim pulse phase $\phi_d$ with respect to the current phase lag $\Delta\phi$. More particularly, if a dim angle $\phi_A$, defined as $\phi_A=\phi_d-\Delta\phi$, is close to zero, the lamp power will be close to nominal power and there will be little dimming. It the dim angle $\phi_A$ increases, the dark period $t_D$ will increase and the current amplitude $I_M$ will decrease, so that the lamp power will decrease and the amount of dimming will increase.

It is noted that dimming can be achieved in this way without generating current peaks into the mains line. It is further noted that a continuous dimming is possible by continuously varying the dim angle $\phi_A$.

Apart from continuous dimming, it may also be desirable to allow operation at two discrete light intensity levels, i.e. power levels $P_L$ (low) and $P_H$ (high). In the state of the art, this is achieved by a design where an auxiliary ballast is switchable in parallel with a main ballast. In this case, the main ballast is designed for the low power level $P_L$, while the auxiliary ballast is designed for a difference power $P_D$ equal to the difference between high power level $P_H$ and low power level $P_L$. If it is desired that the apparatus operates at the low power level $P_L$, only the main ballast is used. If it is desired that the apparatus operates at the high power level $P_H$, the auxiliary ballast is switched in parallel with the main ballast. A disadvantage of this prior art solution is the need for a second ballast, a switch, and wiring to connect the second ballast and the switch in the apparatus.

According to a further aspect of the present invention, only one ballast is needed, this ballast being designed for the high power level $P_H$. If it is desired that the apparatus operates at a high power level $P_H$, the ballast operates at nominal power. If it is desired that the apparatus operates at the low power level $P_L$, the apparatus is dimmed as discussed above.

Figure 8:
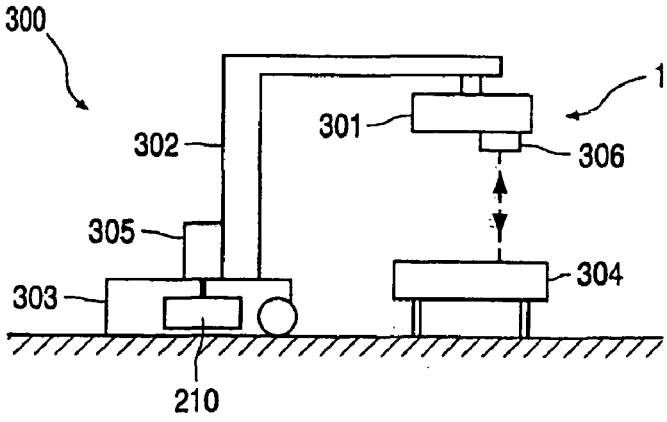
FIG. 8 illustrates a tanning apparatus incorporating the present invention.

In the above, a user-controlled switch D is mentioned, indicating the user's wish to dim the lamp. However, it is also possible that the dimming capabilities are used as a safety measure. By way of example, FIG. 8 schematically shows a tanning apparatus 300, such as, for instance, a solarium or the like, comprising a housing 303, a post 302 which can be placed in a vertical operative position, and one or more lamp housings 301, connected to the post 302 and accommodating one or more gas discharge lamps 1 as described above, of a type designed to generate advantageous ultra-violet light. In operation, the housing 301 is to be placed above a support 304 such as a bed, on which a user can lie down under the lamps 1. For driving the lamps 1, the apparatus 300 comprises one or more drivers 110 or 210 according to the present invention, which in FIG. 8 is depicted within the housing 303 for convenience sake.

The apparatus 300 is designed for a certain nominal light power, to be generated when the vertical distance between lamps 1 and bed 304 has a certain nominal value, as indicated by the length of the post 302. If this vertical distance is too small, the light intensity might be too high for the user.

In accordance with a further aspect of the present invention, the apparatus 300 comprises a detector 305 associated with the post 302, and supplying to the control unit 120, 220, for instance at the dim signal input 122, 222 thereof, a signal which is indicative of the length of the post 302, i.e. indicative of said vertical distance. The control unit 120, 220 is adapted to dim the lamp or lamps 1 in response to the detector signal, the dimming being performed in accordance with the inventive method described above, in such a way that the light intensity as received by a user will remain within a predetermined nominal range, even though the length of the post 302 may be less than nominal.

In a more sophisticated embodiment, the apparatus 300 comprises a distance detector 306 associated with at least one of the lamp housings 301, this detector 306 being designed for directly measuring the vertical distance between said lamp housing 301 and an object below said lamp housing 301, and supplying to the control unit 120, 220, for instance at the dim signal input 122, 222 thereof, a signal which is indicative of said vertical distance as measured. This distance detector 306 may comprise, for instance, a PSD (position sensitive detector). In a suitable embodiment, the distance detector 306 may operate on the basis of sending waves and detecting reflected waves, such as sound waves (ultrasonic transceiver) or light waves. Since such detectors are known per se, while state of the art detectors can be applied here, no further discussion of their design and operation is necessary here.

It should be clear to a person skilled in the art that the above may apply in any situation where an illumination apparatus is expected to generate a desired light intensity on an object to be illuminated.

As described above, the present invention allows dimmed operation of a gas discharge lamp. This is already advantageous because of the mere fact that an illumination intensity can be controlled, as mentioned. However, a further advantage is that it is now easier to maintain a certain desired operating temperature of (parts of) the apparatus itself, which is particularly useful in appliances comprising UV-light generating lamps such as are used in a tanning apparatus such as a solarium or the like, as will be explained hereinafter.

As will be known to a person skilled in the art, UV light as generated by a gas discharge lamp comprises two components indicated as UVA and UVB. UVA is advantageous light for tanning purposes, but UVB is disadvantageous. Unfortunately, the contribution of the advantageous UVA light in the light output is relatively small, so that it is necessary to use high-intensity lamps in order to obtain a useful UVA output, which involves, however, the generation of a large intensity of UVB. In order to prevent this disadvantageous UVB light to reach a person, the light output must be filtered by a filter substantially passing all UVA and substantially blocking all UVB. Since UVA and UVB are quite close to each other in the spectrum, such a filter must have very sharp filter characteristics. Suitable filter glasses meeting these requirements are known in the art. A problem with such known filter glasses is that their filter characteristics are temperature-dependent.

Generally, the gas discharge lamps will be manufactured within certain tolerances which will reflect on their light output. However, apparatus specifications require that the UVA output is within a certain range, because the user should not be exposed to an intensity which is too high, while, on the other hand, the user expects a certain useful intensity. It has been found that the amount of UVA in the light output depends directly on lamp power. Thus, with the dimming capabilities of the invention as discussed above, it is possible to directly manipulate the amount of UVA generated by the lamp. Therefore, the present invention foresees a calibration procedure after a lamp has been manufactured. In such a calibration procedure, the lamp is coupled to a driver and is switched ON; then, in the steady state, the amount of UVA is measured under controlled conditions. The amount (or intensity) of UVA as measured should be in conformity with certain specifications. If the measured intensity is too high, the lamp power will be reduced (dimmed operation in accordance with the invention as described above) in such a way that the measured intensity will be in conformity with specifications.

Thus, it is possible to reduce a tolerance range, or to reduce the percentage of rejection.

The lamp housing for a lamp has been designed in accordance with a certain nominal lamp power. In accordance with this design, the lamp housing will assume a certain nominal operating temperature. However, if the lamp is dimmed, i.e. operated at a reduced lamp power, the lamp housing will obtain a lower operating temperature. This will have consequences for the temperature of the filter, which in turn, as explained above, will have consequences for the amount of UVB output.

Figure 10:
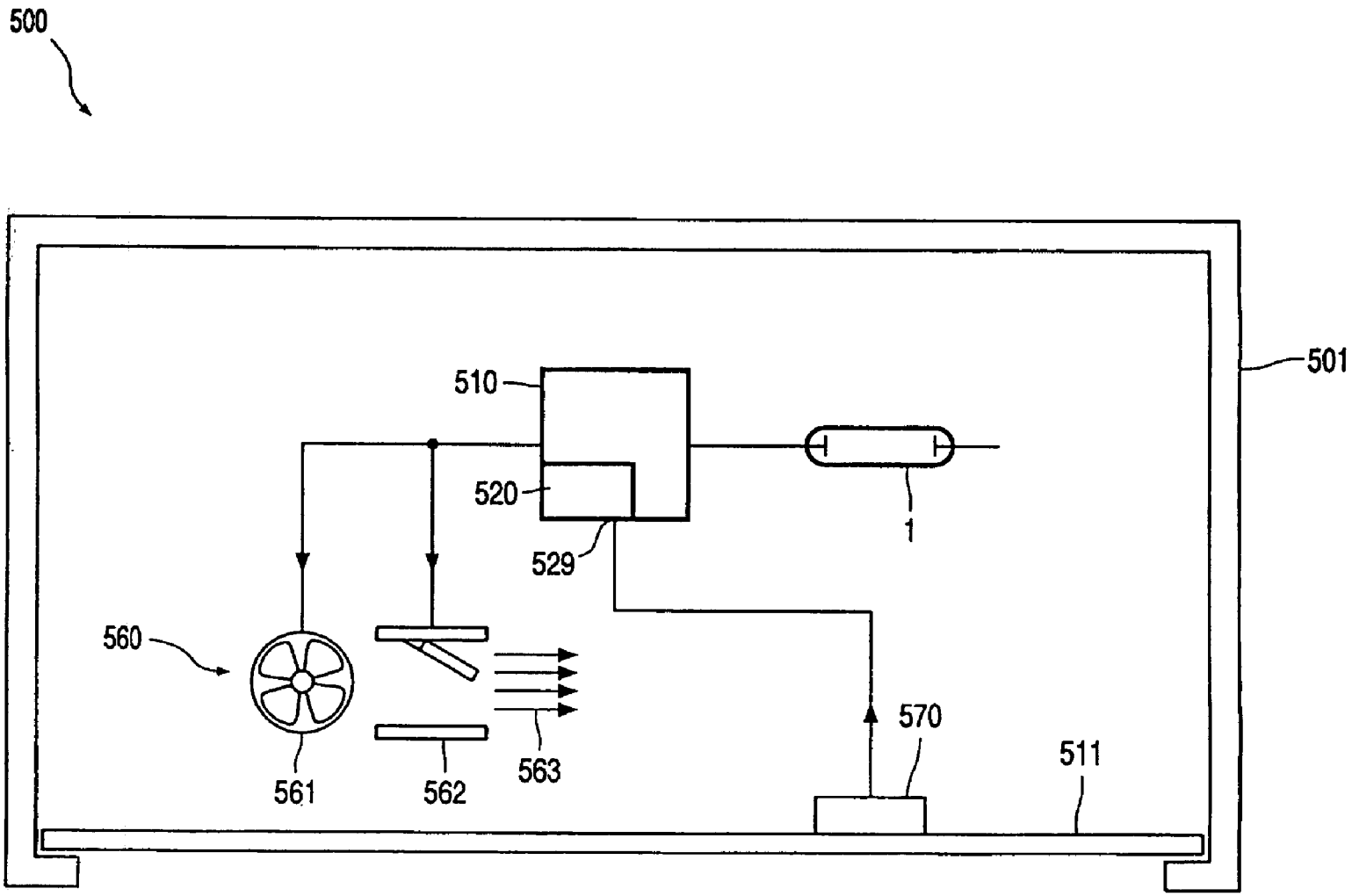
FIG. 10 illustrates a tanning apparatus in accordance with the invention having cooling means.

According to a further aspect of the present invention, illustrated in FIG. 10, a lamp housing 501 of a tanning apparatus 500 is provided with controllable cooling means 560. Furthermore, a control unit is adapted to control such cooling means. This control unit may be a separate control unit, but, as illustrated, it may also be the same control unit as the control unit 520 of the driver 510 already mentioned for controlling the operation of the lamp 1.

In an advantageous embodiment, the cooling means 560 comprise a blower 561 for blowing cooling air 563. In order to perform temperature control, said control unit 520 may control the blower motor speed, but it is also possible that the cooling means 560 comprise a controllable air valve 562 controlled by the control unit 520.

The control unit 520 may be adapted to control said cooling means in relation to lamp power in accordance with a predetermined relationship, which may be stored in a memory associated with the control unit 520, for instance, as a formula or as a table, as will be clear to a person skilled in the art. Said relationship may be fixed for a certain lamp type, or it may be established for each individual lamp.

It is also possible that the calibration procedure as mentioned above comprises, after having set the lamp power in order to obtain a certain UVA level, a step of setting the cooling power to a suitable value in order to obtain a suitable operating temperature of the filter glass so as to obtain a certain UVB level.

In a more sophisticated embodiment, the lamp housing 501 is provided with a temperature sensor 570, preferably a sensor associated with the filter glass 511 in order to generate a sensor signal which is representative of the actual filter glass temperature, the sensor output being connected to a sensor input 529 of the control unit 520. The control unit 520 is adapted to control said cooling means 560 in such a way that the actual filter glass temperature as represented by the sensor signal maintains a predetermined desired value.

The present invention provides a further safety measure which is particularly intended for UV-light generating lamps such as are used in a tanning apparatus such as a solarium or the like, although this further safety measure is applicable in any device for driving inductive loads, especially gas discharge lamps. In the case of a tanning apparatus, it is commonly known that illumination should take place for a predetermined period of time, and not longer, this time being selected by the user in accordance with a tanning scheme. For this purpose, a tanning apparatus comprises a timer to be set by the user: the purpose of this timer is to switch off the lamps of the apparatus when the time period set by the user has expired. However, if for any reason this timer fails to switch off the lamps of the tanning apparatus, the danger of burning arises.

Thus, in order to increase the safety of a tanning apparatus, there is a need for a safety switch which automatically switches off the lamps, even if the timer circuit fails. According to a further elaboration of the present invention, the driver described above can be relatively easily adapted to incorporate such a safety measure.

Figure 9:
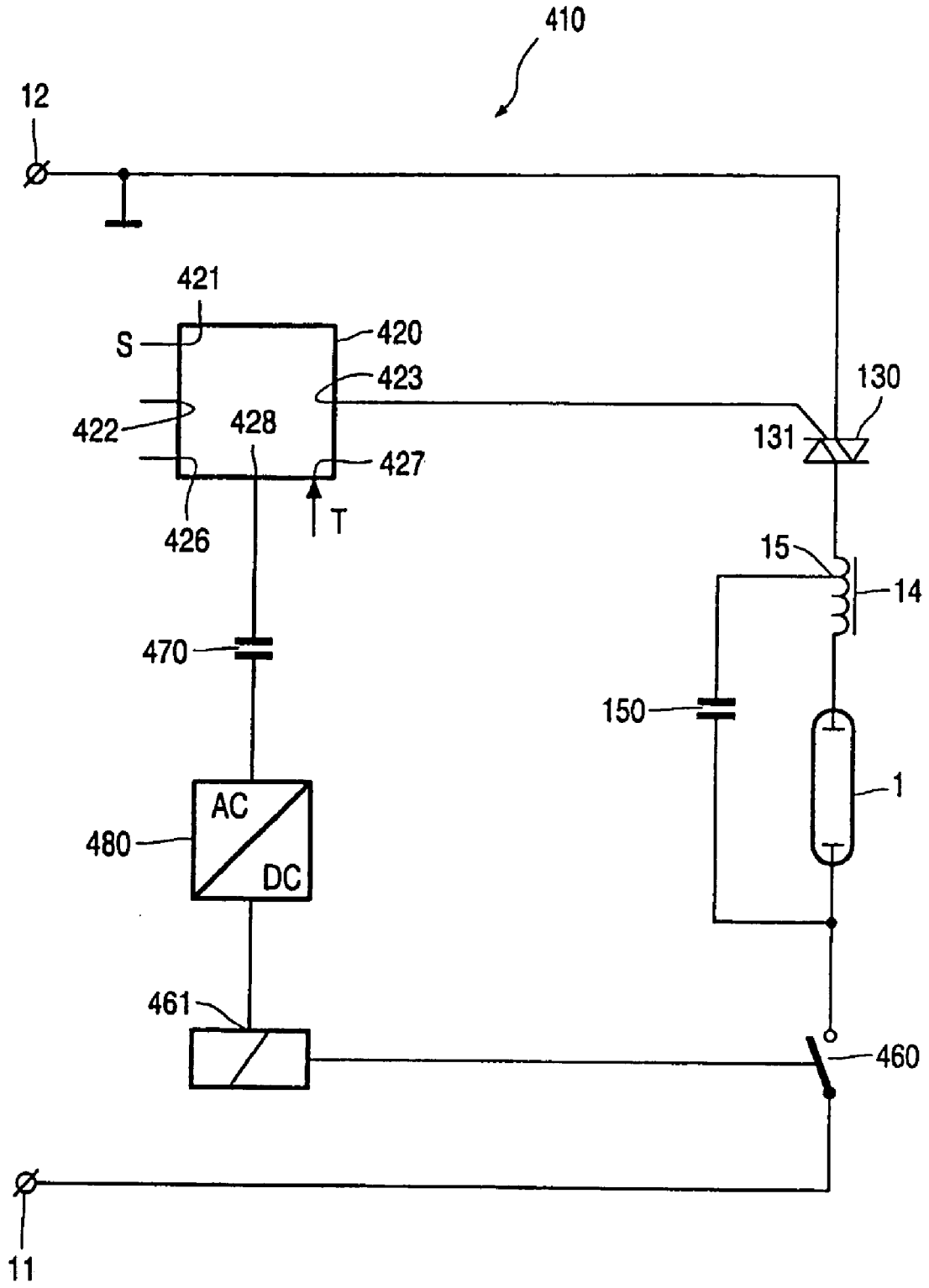
FIG. 9 illustrates a driver provided with a safety measure in accordance with the invention.

FIG. 9 is a block diagram schematically illustrating a further embodiment 410 of a driver in accordance with the present invention, in which said safety measure is incorporated. The control unit 420 may have a dim signal input 422, a start signal input 421, a phase sense input 426, and a trigger signal output 423, as described above. Furthermore, control unit 420 has a timer setting input 427 for receiving a timer command T from a user, indicating the desired length of illumination. As will be clear to a person skilled in the art, the control unit 420 is adapted to start the lamp 1 on receiving a start command S at its start signal input 421, and to maintain operation of the lamp 1 until the expiration of the time set by the timer command T from the user, at which moment the control unit 420 is adapted to stop triggering the triac 130.

If, however, the triac 130 fails in that it constitutes a short circuit, even without triggering, the lamp 1 will not go OFF if the control unit 420 stops triggering the triac 130.

On the other hand, if the control unit 420 does not function properly, for instance because an internal clock fails so that the control unit cannot determine the expiration of the time set by the user, the control unit may get stuck in its triggering mode and indefinitely continue triggering the triac 130.

In order to overcome these problems, the driver 410 comprises a controllable safety switch 460 connected in series with the lamp 1. Preferably, and as shown, this controllable safety switch 460 is implemented as a relay. The control unit 420 has a safety output 428 for driving the safety switch 460. The control unit 420 is adapted to generate, at its safety output 428, an alternating safety signal, which may be sine-shaped, block-shaped, triangularly shaped, etc. A capacitor 470 is coupled between this safety output 428 and an input of an AC/DC converter 480, an output of which is connected to a control input 461 of the controllable safety switch 460.

In response to receiving a start command S at its start signal input 421, the control unit 420 is adapted to start generating said alternating safety signal at its safety output 428, and to continue generating said alternating safety signal until the expiration of the time set by the timer command T from the user, at which moment the control unit 420 is adapted to stop generating said alternating safety signal.

The operation is as follows. The safety signal at the safety output 428 passed by the capacitor 470 to the input of the AC/DC converter 480 is converted into DC voltage and applied to the control input 461 of the controllable safety switch 460, so that the controllable safety switch 460 is actuated into a closed state. At the expiration of the time set by the user, the control unit 420 stops generating trigger pulses for the triac 130 and also stops generating said alternating safety signal for the controllable safety switch 460, so that, in normal circumstances, both the triac 130 and the safety switch 460 turn to an open condition and the lamp 1 goes OFF. If, for any reason, the triac 130 fails to go OFF, the lamp 1 will go OFF anyway because the controllable safety switch 460 turns to its open condition. If the internal (or external) clock of the control unit 420 fails, or the control unit 420 gets stuck in a certain state for any reason, the control unit 420 will not generate an alternating signal anymore at its safety output 428, but will instead generate a constant signal of an undefined nature. Then, the output signal of the capacitor 470, and especially the output signal of the AC/DC converter 480, will go to zero so that the controllable safety switch 460 turns to its open condition even if the control unit 420 continues triggering the triac 130.

As an alternative, the AC/DC converter 480 may, in principle, be omitted if the safety switch 460 is adapted to be actuated by alternating voltage.

Although the present invention has been explained in the foregoing by descripting some preferred embodiments, it should be clear to a person skilled in the art that the present invention is not limited to such embodiments; rather, various variations and modifications are possible within the protective scope of the invention as defined in the appendent claims. For instance, the principles of the present invention are applicable in driving any type of inductive load.

Furthermore, in the embodiments illustrated in FIGS. 3A–B, the first controllable switch 130 is arranged at the side of the lamp directed away from the ballast. Alternatively, this switch may also be arranged at the side of the ballast directed away from the lamp.

The invention claimed is:

1. A driver for driving a gas discharge lamp, comprising:

first and second input terminals for receiving an input voltage;

first and second output terminals for connection to electrodes of the lamp;

a first controllable switch connected in series with said output terminals, the first controllable switch having a control input;

controllable voltage-generating means for generating a high voltage pulse at one of said output terminals;

a control unit for controlling the voltage generating means and for controlling the first controllable switch at a predetermined phase after a zero-crossing of said input voltage to maintain a lamp current substantially at a zero level from before the generated high voltage pulse until the generated high voltage pulse.

2. A driver for driving a gas discharge lamp, comprising:

first and second input terminals for receiving an input voltage;

first and second output terminals for connection to electrodes of the lamp;

a first controllable switch connected in series with said output terminals, the first controllable switch having a control input;

controllable voltage-generating means for generating a high voltage pulse at one of said output terminals;

a control unit for controlling the voltage generating means and for controlling the first controllable switch at a predetermined phase after a zero-crossing of said input voltage, wherein said controllable voltage-generating means comprises an inductive ballast implemented as an auto-transformer having an output end connected to said one output terminal and further having a central tap;

the driver further comprising a capacitor having one terminal connected to said central tap of the inductive ballast.

3. The driver according to claim 2, wherein the other terminal of said capacitor is connected to the other output terminal.

4. The driver according to claim 2, wherein the other terminal of said capacitor is connected to a second controllable switch, the series combination of said capacitor and said second controllable switch being connected in parallel with said output terminals;

wherein the control unit has output terminals connected to control inputs of said first and second controllable switches.

5. The driver according to claim 1, wherein the control unit has a sense input connected to a zero-crossing detector coupled to one of said first and second input terminals, for detecting said zero-crossing of the input voltage.

6. The driver according to claim 1, wherein said first controllable switch comprises a triac.

7. The driver according to claim 1, wherein said predetermined time is in the range of $\Delta\Phi$ to 90°, wherein said $\Delta\Phi$ is a phase lag of a lamp current with respect to the input voltage during steady-state operation.

8. The driver according to claim 7, wherein said predetermined time is in the range of $\Delta\Phi+10°$ to $\Delta\Phi+15°$.

9. The driver according to claim 7, for a lamp wherein said $\Delta\Phi$ is approximately equal to 70°, and wherein said predetermined time is approximately equal to 85°.

10. The driver according to claim 1, wherein the control unit is adapted to continue switching said first controllable switch only once at said predetermined time after each said zero-crossing of the input voltage during a predetermined ignition stage, and wherein the control unit is adapted to continuously maintain at least said first controllable switch in a conductive state during steady-state operation after said ignition stage.

11. A driver for driving a gas discharge lamp, comprising:
first and second input terminals for receiving an input voltage;
first and second output terminals for connection to electrodes of the lamp;
a first controllable switch connected in series with said output terminals, the first controllable switch having a control input;
controllable voltage-generating means for generating a high voltage pulse at one of said output terminals;
a control unit for controlling the voltage generating means and for controlling the first controllable switch at a predetermined phase after a zero-crossing of said input voltage, wherein the control unit has a dim signal input, and wherein, in response to receiving a dim signal at said dim signal input, the control unit is adapted to enter a dim stage in which the control unit switches said first controllable switch only once at a predetermined dim pulse phase after each said zero-crossing of the input voltage, said dim pulse phase preferably being in the range of $\Delta\Phi$ to 90°.

12. A driver for driving a gas discharge lamp, comprising:
first and second input terminals for receiving an input voltage;
first and second output terminals for connection to electrodes of the lamp;
a first controllable switch connected in series with said output terminals, the first controllable switch having a control input;
controllable voltage-generating means for generating a high voltage pulse at one of said output terminals;
a control unit for controlling the voltage generating means and for controlling the first controllable-switch at a predetermined phase after a zero-crossing of said input voltage, the driver further comprising:
a controllable safety switch connected in series with said output terminals, the controllable safety switch having a safety control input;
the control unit further having a safety output for controlling the controllable safety switch, the control unit being adapted to generate, at said safety output, an alternating safety signal;
actuating means connected between said safety output of the control unit and said safety control input of the controllable safety switch, said actuating means being adapted to generate an actuation signal for the controllable safety switch only in response to receiving an alternating signal at its input.

13. The driver according to claim 12, wherein said actuating means comprise a capacitor coupled in series between said safety output of the control unit and said safety control input of the controllable safety switch.

14. The driver according to claim 12, wherein said actuating means comprise an AC/DC converter coupled in series between said safety output of the control unit and said safety control input of the controllable safety switch.

15. The driver according to claim 12, wherein the control unit has a timer setting input for receiving a timer command from a user;
wherein the control unit is adapted to actuate the first controllable switch in a closed condition during a time period as determined by said timer command;
wherein the control unit is further adapted to generate said alternating safety signal at its safety output during said time period as determined by said timer command.

16. The driver according to claim 12, wherein the controllable safety switch is implemented as a relay.

17. A tanning apparatus, comprising:
a lamp housing accommodating said gas discharge lamp for generating advantageous UV light, the lamp housing being adapted to be arranged at a height with respect to an object;
the tanning apparatus further comprising a driver according to claim 1 for driving said gas discharge lamp.

18. A tanning apparatus comprising:
a lamp housing accommodating said gas discharge lamp for generating advantageous UV light, the lamp housing being adapted to be arranged at a height with respect to an object;
the tanning apparatus further comprising a driver for driving a gas discharge lamp, said driver comprising:
first and second input terminals for receiving an input voltage;
first and second output terminals for connection to electrodes of the lamp;
a first controllable switch connected in series with said output terminals, the first controllable switch having a control input;
controllable voltage-generating means for generating a high voltage pulse at one of said output terminals;
a control unit for controlling the voltage generating means and for controlling the first controllable switch at a predetermined phase after a zero-crossing of said input voltage to maintain a lamp current substantially at a zero level until the generated high voltage pulse,
a detector coupled to an input of the control unit;
wherein said detector is adapted to provide a signal which is indicative of said height of said lamp housing above said object;
and wherein the control unit is adapted to enter a dim stage in response to a signal received from the detector.

19. The tanning apparatus according to claim 18, wherein said lamp housing is connected to the upper end of an extendable post;
wherein said detector is associated with the post and is adapted to provide a signal which is indicative of a length of the post.

20. The tanning apparatus according to claim 18, wherein said detector is a distance measuring sensor associated with the lamp housing and is adapted to measure said height of said lamp housing above said object, the detector operating based on reflected sound or reflected light.

21. A tanning apparatus comprising:
a lamp housing accommodating said gas discharge lamp for generating advantageous UV light, the lamp housing being adapted to be arranged at a height with respect to an object;
a driver for driving said gas discharge lamp,
said driver comprising:
first and second input terminals for receiving an input voltage;
first and second output terminals for connection to electrodes of the lamp;
a first controllable switch connected in series with said output terminals, the first controllable switch having a control input;
controllable voltage-generating means for generating a high voltage pulse at one of said output terminals;
a control unit for controlling the voltage generating means and for controlling the first controllable switch at a predetermined phase after a zero-crossing of said input voltage to maintain alarm current substantially at a zero level until the generated high voltage pulse;

a filter glass arranged in front of the gas discharge lamp, designed to substantially pass UVA and to substantially block UVB;

controllable cooling means; and a cooling control unit for controlling said controllable cooling means.

22. The tanning apparatus according to claim 21, wherein said controllable cooling means comprise a blower for blowing cooling air, and a controllable air valve;

wherein said cooling control unit is adapted to control at least one of the blower motor speed, and said controllable air valve.

23. The tanning apparatus according to claim 21, wherein said cooling control unit is adapted to control said cooling means in relation to lamp power in accordance with a predetermined relationship.

24. The tanning apparatus according to claim 21, wherein the lamp housing is further provided with a temperature sensor associated with the filter glass in order to generate a sensor signal which is representative of the actual filter glass temperature, the sensor output being connected to a sensor input of the cooling control unit;

and wherein the cooling control unit is adapted to control said cooling means in such a way that the actual filter glass temperature as represented by the sensor signal maintains a predetermined desired value.

25. A driver for driving a discharge lamp, comprising:

a controllable voltage generator configured to generate a voltage pulse at a first output terminal of said driver;

a first controllable switch connected between a second output terminal of said driver and an input terminal of said driver; and a control unit configured to control the voltage generator and the first controllable switch at a predetermined phase after a zero-crossing of an input voltage of said driver to maintain a lamp current substantially at a zero level from before the generated voltage pulse until the generated voltage pulse.

26. The driver of claim 25, further comprising a zero-crossing sensor coupled to said input terminal and configured to detect said zero-crossing of said input voltage.

27. The driver of claim 25, further comprising a second controllable switch connected across said first and second output terminals; said control unit being further configured to control second controllable switch.

28. The driver of claim 27, further comprising a capacitor connected between said first output terminal and said second controllable switch.

29. A driver for driving a discharge lamp, comprising:

a controllable voltage generator configured to generate a voltage pulse at a first output terminal of said driver;

a first controllable switch connected between a second output terminal of said driver and an input terminal of said driver; and a control unit configured to control the voltage generator and the first controllable switch at a predetermined phase after a zero-crossing of an input voltage of said driver, the driver further comprising:

a second controllable switch connected across said first and second output terminals; said control unit being further configured to control second controllable switch; and a controllable safety switch connected in series with said first and second output terminals; said control unit being further configured to control said controllable safety switch.

30. A tanning apparatus comprising:

a discharge lamp; and a driver for driving said discharge lamp;

said driver comprising:

a controllable voltage generator configured to generate a voltage pulse at a first output terminal of said driver;

a first controllable switch connected between a second output terminal of said driver and an input terminal of said driver; and a control unit configured to control the voltage generator and the first controllable switch at a predetermined phase after a zero-crossing of an input voltage of said driver to maintain a lamp current substantially at a zero level from before the generated voltage pulse until the generated voltage pulse.

31. A tanning apparatus of claim 30, further comprising:

a detector coupled to an input of the control unit;

wherein said detector is configured to provide a signal which is indicative of a height of said discharge lamp above an object configured to receive illumination from said discharge lamp;

and wherein the control unit is further configured to enter a dim stage in response to a signal received from the detector.

* * * * *